United States Patent [19]

Mittelsteadt et al.

[11] Patent Number: 4,493,960

[45] Date of Patent: Jan. 15, 1985

[54] CERAMIC BLINDERS FOR A MICROWAVE OVEN QUARTZ LAMP

[75] Inventors: Robert A. Mittelsteadt, Burnsville; Gregory W. Machesney, Oakdale, both of Minn.

[73] Assignee: Micro-Quartz Technology Corp., Minneapolis, Minn.

[21] Appl. No.: 407,377

[22] Filed: Aug. 12, 1982

[51] Int. Cl.[3] ..... H05B 6/80; H05B 3/44

[52] U.S. Cl. ..... 219/10.55 B; 219/10.55 R; 219/348; 219/347; 219/405

[58] Field of Search ..... 219/10.55 B, 10.55 R, 219/348, 349, 347, 377, 354, 405, 411, 400; 362/321, 346, 347, 296; 313/113; 99/451, 447

[56] References Cited

U.S. PATENT DOCUMENTS

| | | | |
|---|---|---|---|
| 2,816,204 | 12/1957 | Pastoor | 219/348 |
| 3,746,834 | 7/1973 | Purps | 219/347 X |
| 3,826,014 | 7/1974 | Helding | 219/348 X |
| 4,001,622 | 1/1977 | Howell | 219/347 X |
| 4,032,750 | 6/1977 | Hurko | 219/464 |
| 4,237,368 | 12/1980 | Welch | 219/449 |

*Primary Examiner*—Philip H. Leung

*Attorney, Agent, or Firm*—Edward P. Heller, III; Joseph A. Genovese

[57] ABSTRACT

Disclosed is a half-tube of ceramic paper inserted into the quartz tube of a microwave oven quartz lamp. The ceramic paper acts as a reflector, permitting directional control of the infrared radiation from the quartz lamp.

1 Claim, 16 Drawing Figures

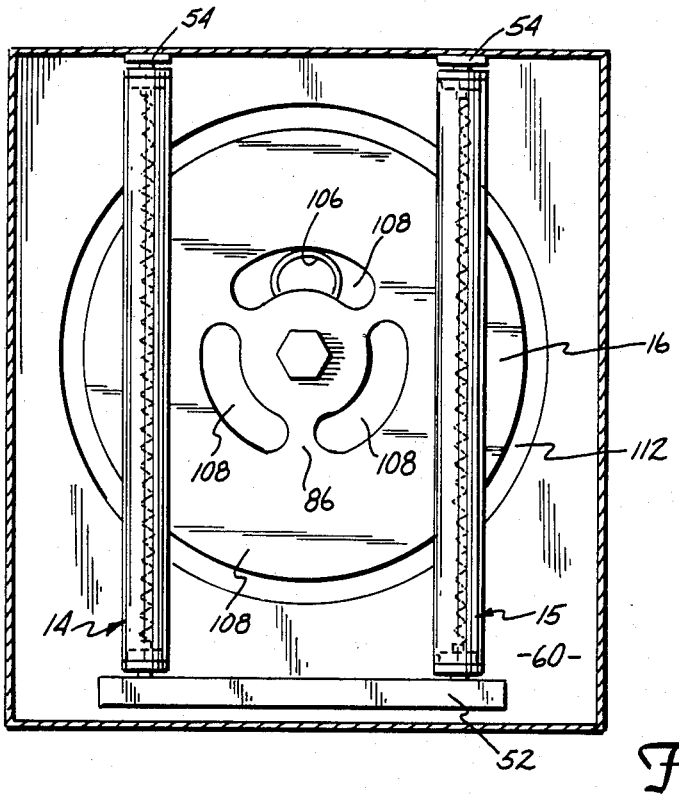
Fig. 3
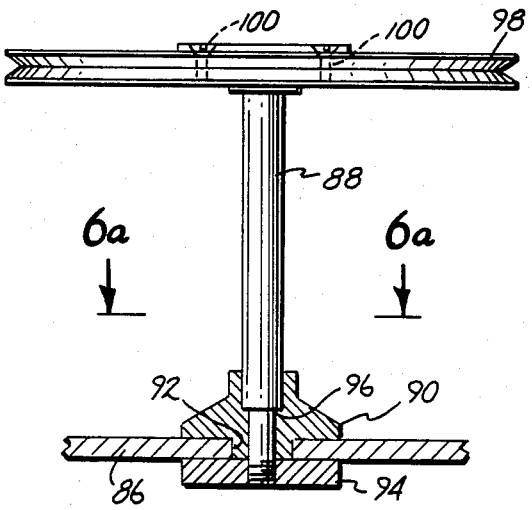
Fig. 6
Fig. 6a
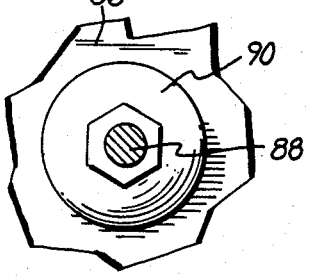

Fig. 5
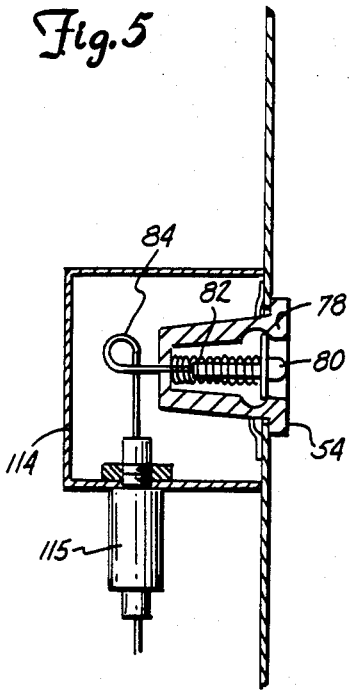
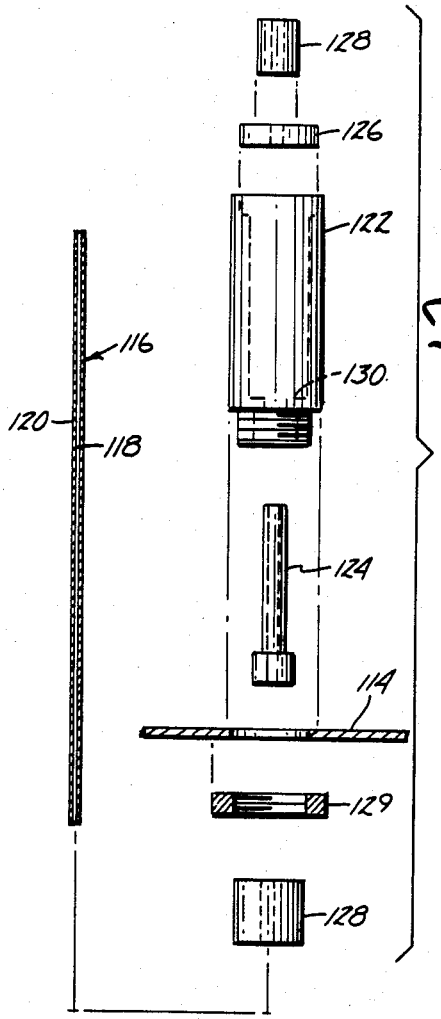
Fig. 8a
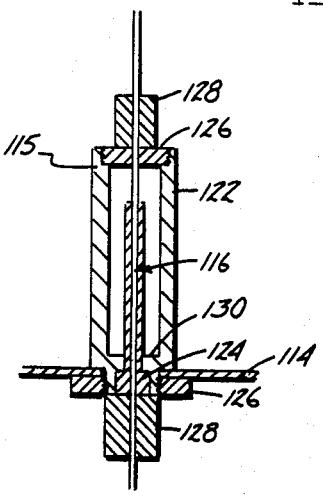
Fig. 8b

CERAMIC BLINDERS FOR A MICROWAVE OVEN QUARTZ LAMP

BACKGROUND OF THE INVENTION

1. Field by the Invention

The invention relates to the field of microwave ovens and more particularly to combination microwave, convection and broiling ovens.

2. Brief Description of the Prior Art

In the copending application for Microwave/Convection and Broiling Oven by Robert A. Mittelsteadt and assigned to the assignee of the present invention, quartz lamps according to FIG. 10 of both that application and this were developed. These worked quite satisfactorily for their intended purpose.

The present invention represents an improved design for such quartz lamps, and has the advantages of performing the same function with fewer and less costly elements, while at the same time improving the appearance of the quartz lamp structure in the oven.

SUMMARY OF THE INVENTION

A half-tube of ceramic paper is inserted into a quartz lamp comprising a spiral metallic resistance element, a quartz tube, two ceramic endcaps and rivet means mounted in said endcaps for attaching said spiral resistance element thereto. A ceramic cement bonds the endcaps to the quartz tube.

BRIEF DESCRIPTION OF THE DRAWINGS

FIG. 3 is a cross sectional view along 3—3 of FIG. 1.

FIGS. *4a, 4b, 4c,* and *4d* are top, plan and side views of the front sockets;

FIG. 5 is a cross sectional view of a rear socket, grounded housing, and quarterwave choke of the present invention.

FIGS. *6a* and *6b* is a cross sectional blowup view of the heat-exchanger shaft and pulley elements.

Figure 1:
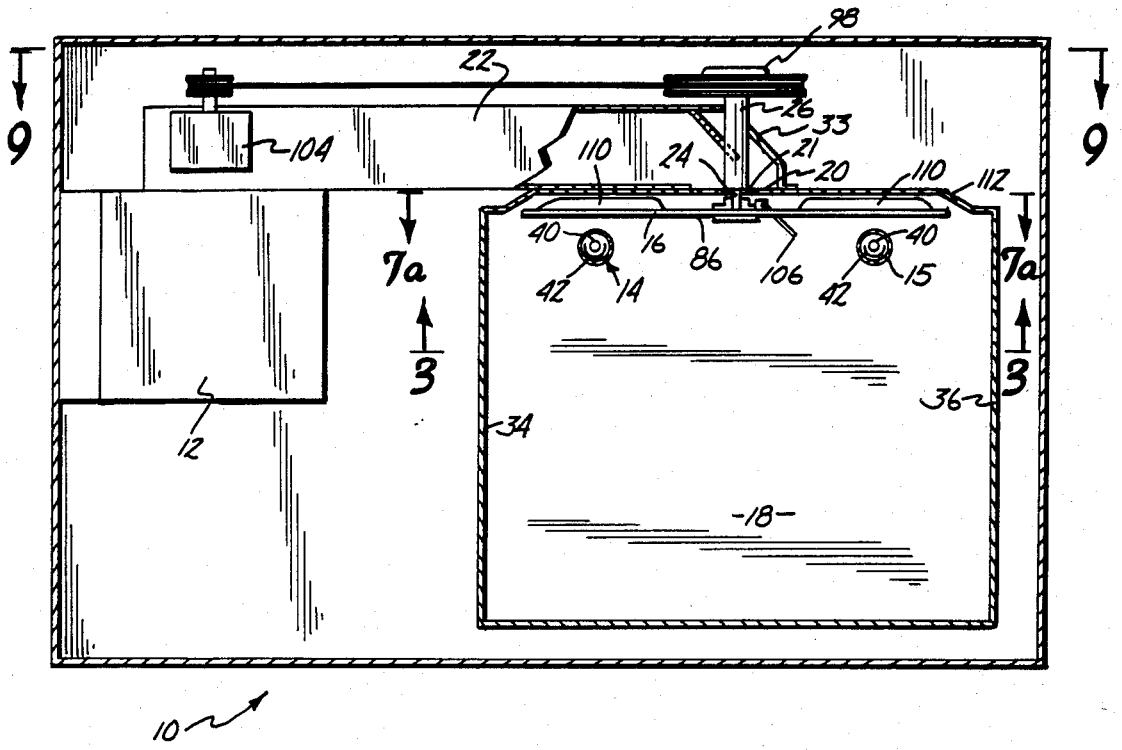
FIG. 1 is a front cross sectional view of the combination oven of the present invention.

FIG. *7a* is a cross sectional view taken along *7a—7a* of FIG. 1.

Figure 9:
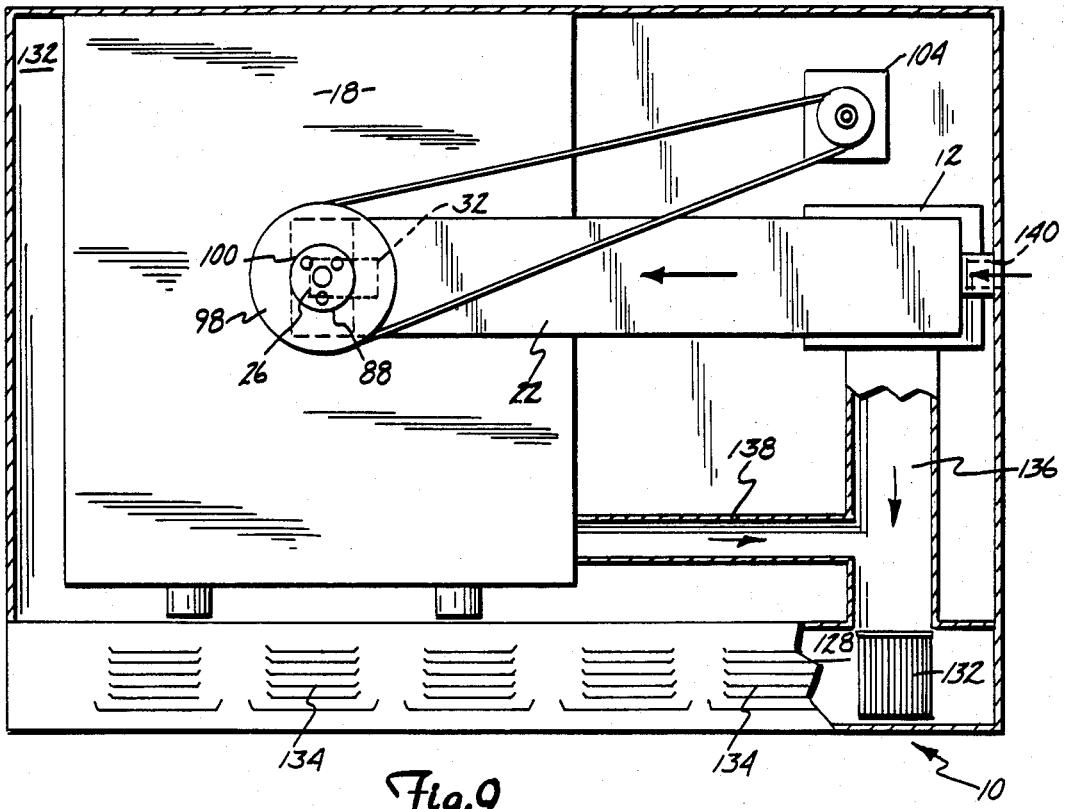
Figure 7A:
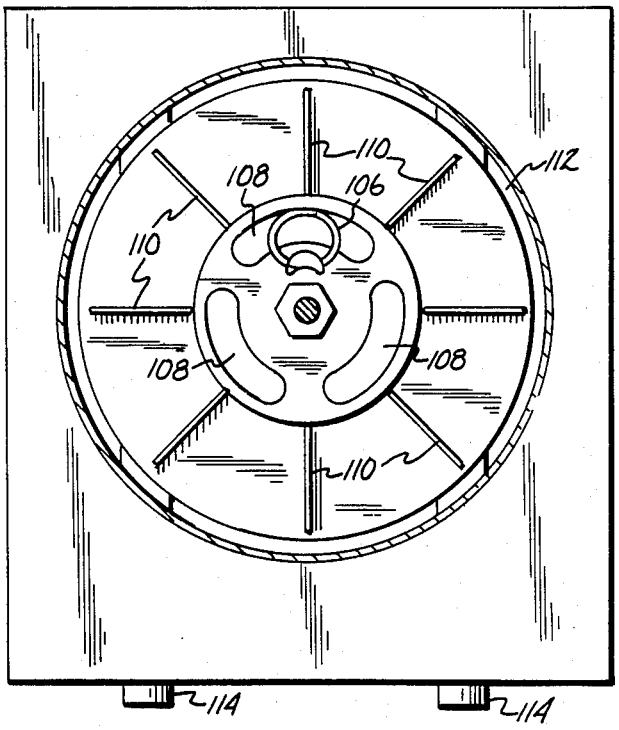

FIG. *7b* is a perspective view of a corrugated heat-exchanger/fan;

FIGS. *8a* and *8b* are a blowup and cross sectional view of a quarterwave choke;

FIG. 9 is a cross sectional view along 9—9 of FIG. 1, including a partial section of the roof of the microwave oven.

Figure 10:
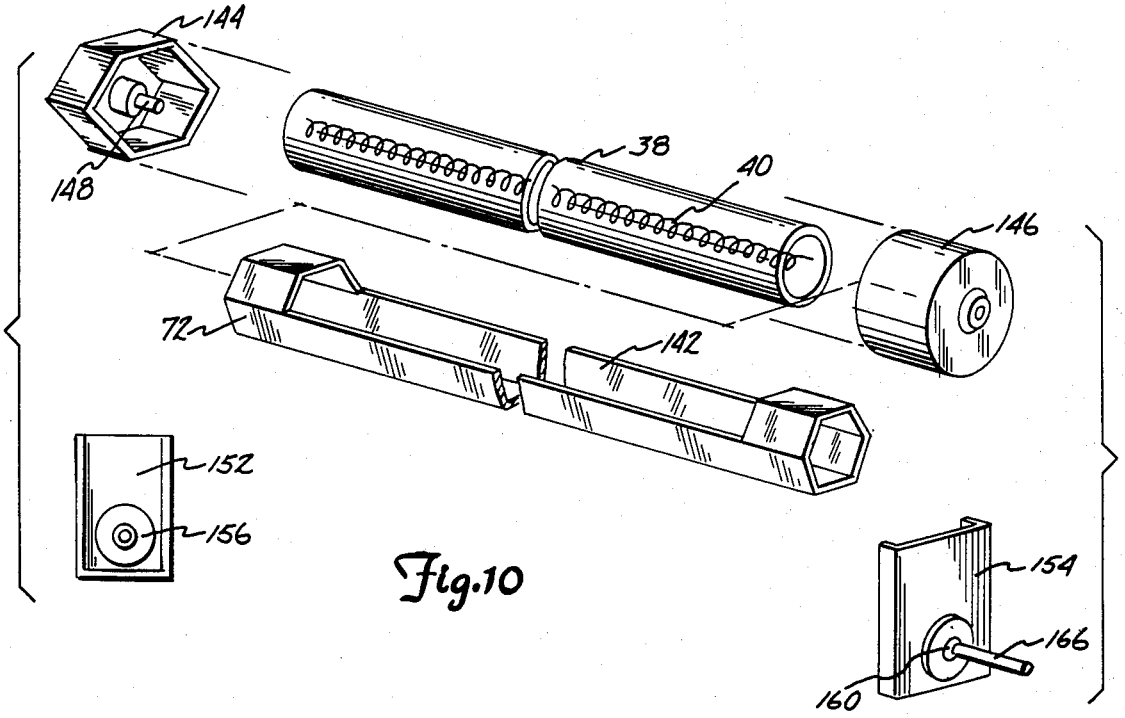

FIG. 10 is a blowup view of an alternative quartz lamp embodiment.

DESCRIPTION OF THE PREFERRED EMBODIMENT

Referring to FIG. 1, microwave/convection/broiling oven 10 includes a magnetron 12, quartz lamps 14 and 15 (FIG. 2) and a heat-exchanger/fan 16. The magnetion 12 generates microwave radiation for microwave cooking. The quartz lamps 14 and 15 generate infrared radiation both for direct broiling and for convection cooking.

The microwaves from magnetron 12 communicate to a top entry port 20 in cavity 18 through waveguide 22. Microwave shield 21 (micra in the preferred embodiment) allows microwave to pass but constricts the passage of air through entry port 22. Heat exchanger/fan 16 is rotatably mounted via shaft 24 and bearing shaft 26. Shaft 24 is connected to pulley 30. Motor 28 drives pulley 30 for rotation of fan 16. The bearing shaft 26 extends through port 20 and waveguide 22. Baffle 32 is angled at 49° relative to the waveguide, and mounted immediately anterior the bearing shaft 26 and partially wraps around it. This baffle 32 deflects microwaves down and out port 20 to avoid backscattering by bearing shaft 26. Baffle 33 is angled at 45°. Quartz lamps 14 and 15 are mounted immediately below heat-exchanger/fan 16. The forward ends of the quartz lamps 14 and 15 are mounted on cavity ceiling and rear ends are mounted on the cavity's rear verticle panel (see below).

The heat-exchanger/fan 16 is driven at a constant angular velocity throughout all cooking operations. The speed of rotation is not critical and may be varied by the designer as desired. In the preferred embodiment, the speed of rotation is 438 r.p.m.'s.

Figure 2:
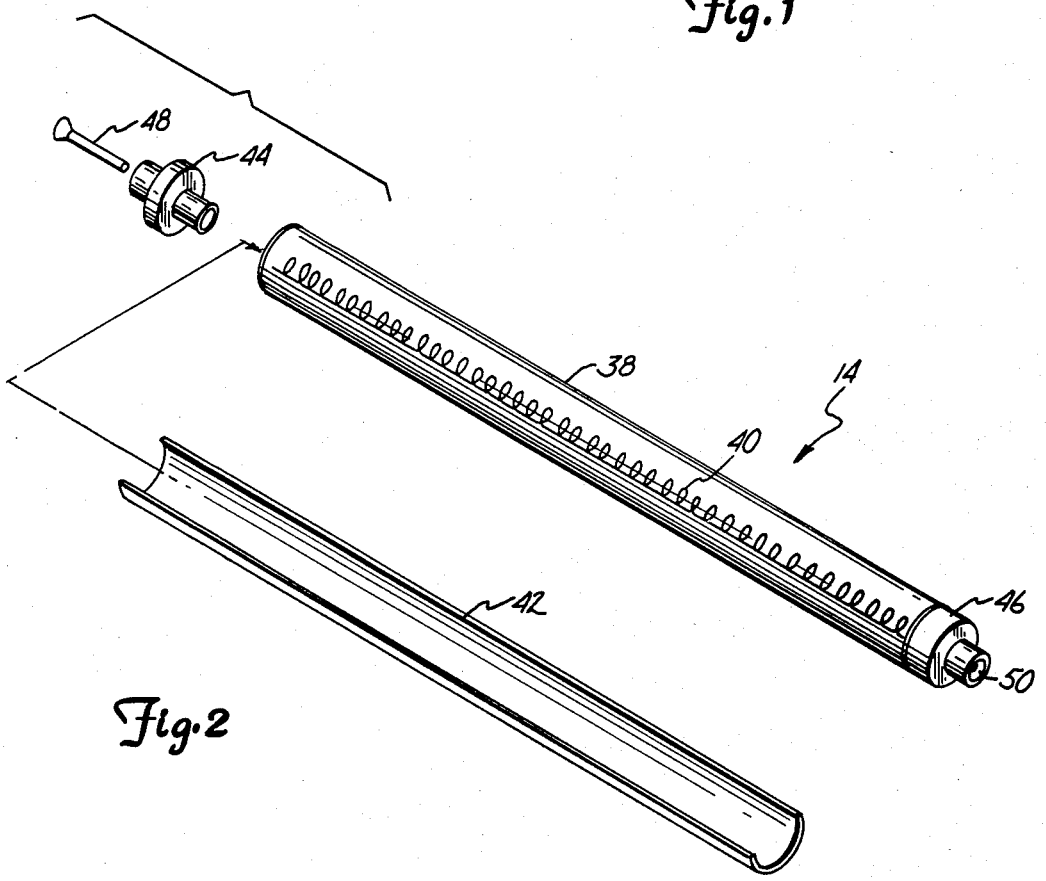
FIG. 2 is a perspective, partial blowup view of a quartz lamp.
Figure 4A:
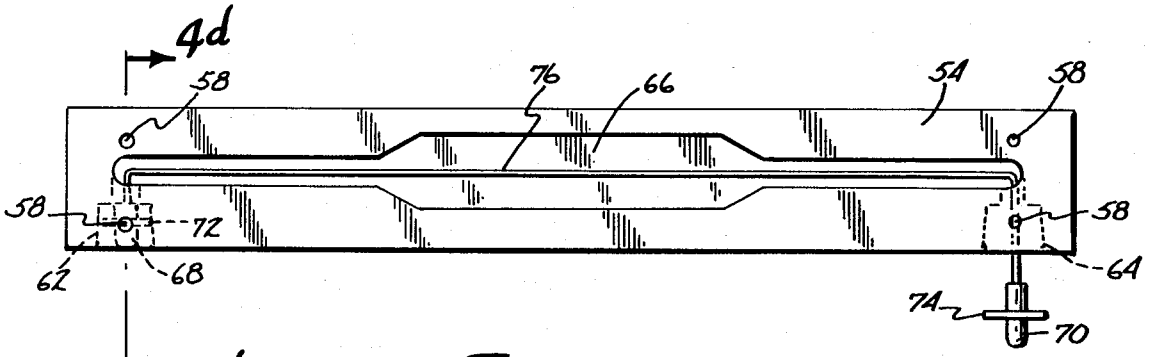
Figure 4B:
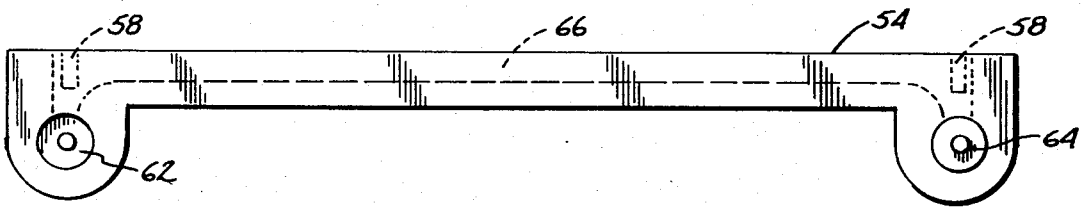
Figure 4D:
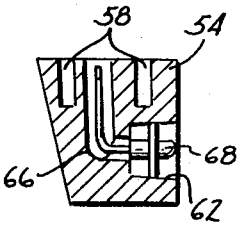
Figure 4C:
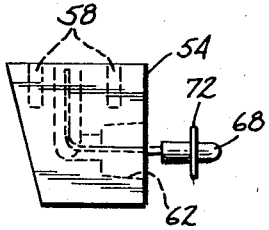
Figure 7B:
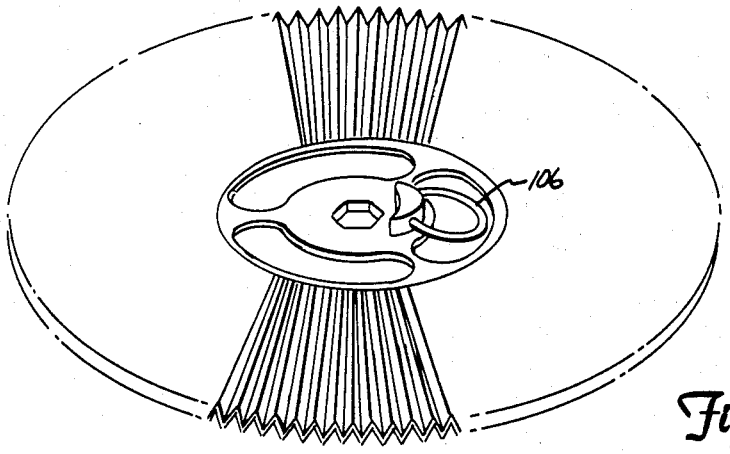

In reference to FIG. 2, each quartz lamp 14, 15 is comprised of a quartz tube 38; a spiral metallic resistance element 40, composed of a resistive metal such as NiCr whose length is adjusted such that after it has been heated it exhibits a small spring tension when it is stretched the length of the quartz tube 38; a half-tube of ceramic paper 42; identical endcaps 44 and 46; and rivets 48 and 50.

The ceramic paper may be obtained from Radiant Heat, Inc., 4 Sawyer Dr., Coventry, R.I. 02816.

The quartz lamp is assembled by placing the fragile ceramic paper around the coiled spring 40, inserting the combination into the tube 38, inserting the rivets 48 and 50 into endcaps 44 and 46, inserting the end of the coil 40 into one rivet and crimping it, and then into the other and crimping it. Electricity is then applied to the coil. After it has been heated, it contracts, and the spring tension hold encaps 44 and 46 on the ends of quartz tube 38. An inorganic cement may be used to seal the endcaps to the quartz tubes, this to prevent damage to the lamp when removed from the oven.

The quartz lamps 14, 15 are mounted in cavity 18 between front sockets 52 and rear sockets 54. The front sockets 52 are shown in FIG. 4. A rear socket in FIG. 5.

Referring to FIG. 4, front sockets 52 are comprised of a housing 56 having formed therein four screw holes 58 for attachment to the cavity roof 60 (FIG. 3); two tapered recesses 62 and 64, and a communications channel 66 therebetween. Pins 68 and 70, having pressed-fit washers 72 and 74, are adapted to precision fit into tapered recesses 62 and 64. Insulated wire 76, the ends of which are crimped-attached to pins 68 and 70, electrically connect the two pins via channel 66.

One of the two rear sockets 54 is illustrated in FIG. 5. It is a commercially available spring loaded socket from Ultra Heat Corp., P.O. Box 1166, Cinnaminson, N.J. 08077.

Its salient features are housing 78 in which is captured pin and washer combination 80 and a spring 82 to forward bias the pin 80. Wire 84 is crimp-attached to pin 80.

The flared end of rivets 48 and 50 (FIG. 2) mate with the respective front and rear pins 68 or 70, 80 and are free to rotate thereon. Rotation is presently manual. However, other suitable means may be employed. Automatic means may be the most commercially viable. However, rotation may not be necessary at all due to the large amount of reflected infrared available for broiling. Turning the fan off may be another broiling technique.

The presence of the half tube of ceramic paper 42 in a lamp 14 or 15, blocks radiation in one direction and exposes the resistance element 38 for direct radiation of infrared in the other, through approximately 180°. The half-tubes 42 act then as blinds. The net result is that when the blinds are open upwards, substantially all infrared is likewise directed upwards. And visa-versa.

When directed upward, the infrared radiation from the quartz lamps 14 and 15 impinges on the bottom of heat-exchanger/fan 16. The heat-exchanger/fan is further composed of a good thermal conductor such as aluminum or stainless steel.

In reference to FIGS. 6A and 6B, heat-exchanger/fan 16 is mounted on a hub 86 composed of a microwave transparent material such as ceramic. The hub 86 is secured to shaft 88 by a hex nut 90 inserted through a matching hexogonal hole 92 in hub 86. Nut 94 screws on to the end of shaft 88, capturing hub 86 and nut 90 between it and shoulder 96. Pulley 98 is atttached to shaft 88 via screws 100. Washer 99 acts as a bearing between pulley 98 and bearing shaft 26 (FIG. 1).

Mounted on hub 86 at an angle of approximately 34° from vertical and approximately 1.75 inches from shaft centerline is metallic (brass in the preferred embodiment) ring 106 (FIGS. 1, 3, 4 and 7). The ring 106 projects downwards through one of the three openings 108 in hub 86. This ring acts as a resonant antenna for receiving the microwaves exiting the waveguide 22 and broadcasting them into the cavity at an oblique angle. The ring's dimensions are 0.1 inch circular cross section and 2" O.D.

Mounted on top of disk 16 are vanes 110 (FIG. 1, 7*a*). They may be of any shape or size and attached or formed on heat-exchanger/fan 16 in any manner. Indeed, it is envisioned that a satisfactory heat-exchanger/fan might be formed by extruding the vanes or pressing its entire disk into a sinusoidal or serrated edge shape (FIG. 7*b*), otherwise known as a convoluted or corrugted shape. The shape of the heat-exchanger/fan is limited by its primary functions, which are to increase the surface area in contact with the air drawn over them during rotation in order to increase heat-transfer efficiency while at the same time performing the function of a fan.

The use of a convoluted surface heat-exchanger/fan (FIG. 7*b*) engages the entire air mass in the cavity and causes it to circulate in the direction of its rotation. The convoluted surface fan is also less expensive to manufacture.

In the preferred embodiment the heat-exchanger/fan 16 is mounted in a dome-shaped recess 112 in the ceiling of the cavity. This recess has several functions:

(1) It channels the air blown out the periphery of the heat-exchanger/fan down the sides of the cavity rather than directly at the sides. This assures that a large portion of the heated air reaches the bottom of the cavity to cook the food rather than being short-circuited back to the central openings.

(2) It moves the bottom of the heat-exchanger/fan up so that it is flush with the top of the cavity to thereby maintain the substantial rectangularity of the cavity and facilitate controlled moding and efficient coupling of microwave energy into the cavity.

(3) It provides for a larger cooking space within a given sized cavity, especially when the quartz lamps are removed.

(4) It provides for the necessary clearance for antenna 106.

The power leads to quartz lamps 14 and 15 will potentially conduct a large amount of microwave energy out of cavity 18. To ground these microwaves, the following structure is employed: The quartz lamps are connected to each other on their forward ends through front sockets 52, which lie entirely within cavity 78. The two rear power leads 84 (FIG. 5) extending from the rear sockets 54 are each contained in a grounded housing 114 and then passed through a quarterwave choke 115 while exiting the housing.

FIG. 8*a* shows a blowup of the quarterwave choke used in the preferred embodiment. The choke elements are all circular in cross section. Power lead 116 is comprised of conductor 118 surrounded by teflon insulator 120. The power lead inserts through the narrow central channel of the other elements of the choke. The choke barrel is comprised of cylinder 122, plug 124, plug 126, nut 129, and insulators 128. The assembled elements are shown in FIG. 8b Nut 126 bolts cylinder 122 onto grounded housing 114. As in all chokes, the critical dimension is the distance illustrated in FIG. 9 as ¼ or one-quarter of the free-space wavelength of the nominal microwave frequency. In the preferred embodiment, the interior diameter of cylinder 122 is 0.5 inches, the O.D. of plug 124 inside cylinder 128 is 0.160 inches; the distance plug 124 extends into the interior of cylinder 122 is 0.923 inches, and the interior length of cylinder 122 between plug 126 and wall 130 is 1.265 inches.

FIG. 9 is a top plan view of the inside of oven 10. Pulley 98, pulley motor 104 and grounded housings 114 are shown and have been discussed above. The new elements in the figure relate to the air flow in the oven 10.

Blower motor 132 blows air into plenum 128 and out exhaust ports 134 located on the top of the oven. As a result, the blower 132 creates a partial vacuum in passageways 136 and 138 leading to it. The partial vacuum in passageway 136 draws air through the magnetron's 12 cooling fins (not shown). The source of the air is from the interior of oven 10 and originally from vents (not shown) preferably located in the bottom of the oven 10 as well as from other air leaks present every oven. The location of particular vents can be chosen to cool other components of the oven (not shown) in need of cooling, such as the power supply. The partial vacuum in passageway 138 draws air from cavity 18 which in turn draws air from about the seals in the microwave oven door (not shown) and from waveguide 22, through port 20. The air in the waveguide is provided from the exterior of the oven through passageway 140.

Drawing air in through the microwave oven door seals prevents the escape therefrom of hot vapor-filled air during convection cooking or broiling. It also helps keep the door and door seal cool. It helps prevent the buildup of grease and other contaminants at the door seal which will degrade its effectiveness.

It is desirable to adjust the size of the various vents and passageway above-mentioned to maintain cavity 18 at a negative pressure vis-a-vis the interior 132 of oven 10. This prevents hot, smoke-filled, greasy air from getting into the interior of oven 10.

If the exhaust air is to be exhausted into the interior of the house, it is desirable to include a charcoal filter (not shown) in passageway 128.

Likewise, as an alternative, the passageway 138 from the cavity may be directed to vent directly into plenium 128 near the exhaust of blower motor 132. The high-speed exhaust creates a partial vacuum in the passageway and hot, greasy gasses from cavity 18 bypass the blower motor 132, thereby reducing its possible degredation.

An alternate quartz-lamp embodiment is shown in FIG. 10. This embodiment employs a stainless steel half-tube 142 in lieu of ceramic paper 42. The quartz tube 38 fits inside the half-tube 142. The half-tube 142 has a hex end over which hex endcap 144 fits. Endcap 146 fits over the other end. The spiral heating element 40 attaches to these endcaps via attachment means 148 which is preferrably a rivet; its spring tension holds the assembly together. The recess of the flared end of the rivet 150 removably and rotatably mounts the encaps onto conductive knob means 156, 160. These knob means are mounted in insulator slots 152, 154, which are in turn mounted on the cavity's walls. The knob means 156, 160 attaches to power lead 166 through apertures in the cavities walls (not shown).

While control of the various radiation sources is not within the purview of the present invention, those skilled in the art will appreciate that the magnetron 12 and the quartz lamps 14 and 15 will together draw more power than a 115 volt outlet can supply. Therefore, in the usual case, the controls will have to provide for alternate rather than simultaneous use of the two types of devices.

To increase direct infrared for broiling while the half-tubes are directed upwards for convection cooling, it is possible to provide a slit in the half-tube 42, 142 so that some high frequency infrared strikes the food directly. However, as the bottom of metellic heat-exchanger/fan 16 will reflect a large protion of the infrared to accomplish somewhat the same result, this may seldom be necessary.

Quartz lamps 14 and 15 are used in the preferred embodiment both due to the speed they heat up and the high temperatures they reach. However, the essential features of the combination microwave convection/-broiling oven may be achieved by substituting other forms of infrared heating means for the quartz lamps. If shielded-rod heaters are employed, eyelids 142, similar to those of the alternative embodiment, should be used for control of which direction the infrared is directed.

It will be appreciated that providing the heat-exchanger/fan 16 intermediate the infrared heating devices and the cavity roof as well as having cool air in the waveguide reduces the problem of overheating the cavity roof.

The specification of the elements of the preferred embodiment should not be taken as a limitation of the scope of the appended claims, in which I claim:

1. In a combination microwave/convection/broiling oven having a cavity, a heat-exchanger/fan, one or more quartz lamps mounted adjacent thereto, each having a quartz tube and a resistance element, and blinder means for directing the propagation of infrared radiation from said quartz lamps, the improvement comprising:

said blinder means comprised of a half-tube of ceramic paper mounted on the interior of said quartz tube.

* * * * *